United States Patent [19]

Petry

[11] 4,005,652

[45] Feb. 1, 1977

[54] ADDRESSING MACHINE AND VARIABLE DRAG DRIVE THEREFORE

[75] Inventor: Eduard C. Petry, Richfield, Minn.

[73] Assignee: Speedaddress, Inc., Minneapolis, Minn.

[22] Filed: Feb. 10, 1975

[21] Appl. No.: 548,625

[52] U.S. Cl. ..... 101/131; 101/132.5; 101/232

[51] Int. Cl.[2] ..... B41L 11/12

[58] Field of Search ..... 101/45, 47, 52, 53, 101/130, 131, 132, 132.5, 133, 135, 136, 141, 145, 146, 235, 232

[56] References Cited

UNITED STATES PATENTS

| | | | |
|---|---|---|---|
| 2,519,894 | 8/1950 | Dohl et al. | 101/235 |
| 3,053,176 | 9/1962 | Shepherd | 101/132.5 |
| 3,072,052 | 1/1963 | Bach | 101/235 |
| 3,092,019 | 6/1963 | Buskirk | 101/235 X |
| 3,216,351 | 11/1965 | Ritzerfeld et al. | 101/235 |
| 3,420,162 | 1/1969 | Shepherd | 101/53 |
| 3,444,807 | 5/1969 | Kooch | 101/53 |
| 3,640,215 | 2/1972 | Shepherd | 101/132.5 X |
| 3,807,303 | 4/1974 | Peterson | 101/132.5 |
| 3,855,041 | 12/1974 | Kunisch | 101/232 X |

*Primary Examiner*—Clifford D. Crowder
*Assistant Examiner*—R. E. Suter
*Attorney, Agent, or Firm*—Schroeder, Siegfried, Ryan & Vidas

[57] ABSTRACT

A duplicating machine wherein adjustment of the location of material to be duplicated on the workpiece is accomplished by resiliently coupling to the machine drive system, the shaft which controls the feeding of the cards which carry the printed matter to be duplicated and by providing an adjustable dynamic load on the shaft to alter the positioning of the master card relative to the workpiece to adjust the location of the printed material on the workpiece.

1 Claim, 5 Drawing Figures

ADDRESSING MACHINE AND VARIABLE DRAG DRIVE THEREFORE

The present invention relates to the field of duplicating machines and, in particular, duplicating machines using a spirit transfer or hectograph process to duplicate printing such as an address from a master card onto a workpiece such as an envelope.

In the hectograph duplicating process, the position on the envelope upon which it is desired to duplicate information from the master card is moistened with a solvent. The solvent used is a solvent for the printing material which appears in reverse image form on the imprint area of the master card. After the solvent has been applied to the envelope, the imprint area of the card is aligned with and pressed against the envelope so that it confronts the moistened area of the envelope in the desired location to print the image upon the envelope.

There exist a number of prior art machines for printing material from master cards onto a workpiece. Several of the prior art duplicating machines which are suitable for placing addresses from master cards onto envelopes have also included means for varying location of the address upon an envelope. All of these prior art address adjusting mechanisms have involved the use of complicated electronic timing circuits or complex mechanical adjustment means to provide an address location adjusting feature.

Another disadvantage of prior art addressing systems is that the more complex and expensive systems which utilize automatic envelope feeding means, are manufactured with the automatic feeding means as an integral part of the addressing machine structure so that a substantially different model must be manufactured for sale to smaller users relying upon manual insertion of envelopes. Also, when a customer who initially purchased such a manual feed addressing machine acquires, through expansion of his mailing needs or for other reasons, a need for an addressing machine with automatic envelope feeding means, it has been necessary, with prior art machines, for him to purchase a completely new machine since the design of the prior art addressing mechanisms has not permitted the modular addition of the automatic feeding feature without extensive modification and reconstruction of the original manual machine.

In view of the foregoing, it is, therefore, an object of this invention to provide duplicating apparatus suitable for the addressing of envelopes which is both inexpensive and has simplified modular construction.

It is also an object of this invention to provide duplicating apparatus with a simplified mechanism for adjusting the position of the printed material applied to a workpiece.

It is a further object of this invention to provide duplicating apparatus in modular units so that an addressing apparatus designed for manual feeding of envelopes can be adapted for use with an automatic envelope feeder by purchase of an automatic envelope feeder unit which directly interfaces with the addressing device.

It is a further object of this invention to provide a simplified modular addressing system which is capable of operating from a stack of master addressing cards and utilizes only selected cards for the addressing of envelopes.

These and other objects of the present invention and the various features and details of the operation and construction thereof are hereinafter more fully set forth and described with reference to the accompanying drawings, in which.

Figure 1:
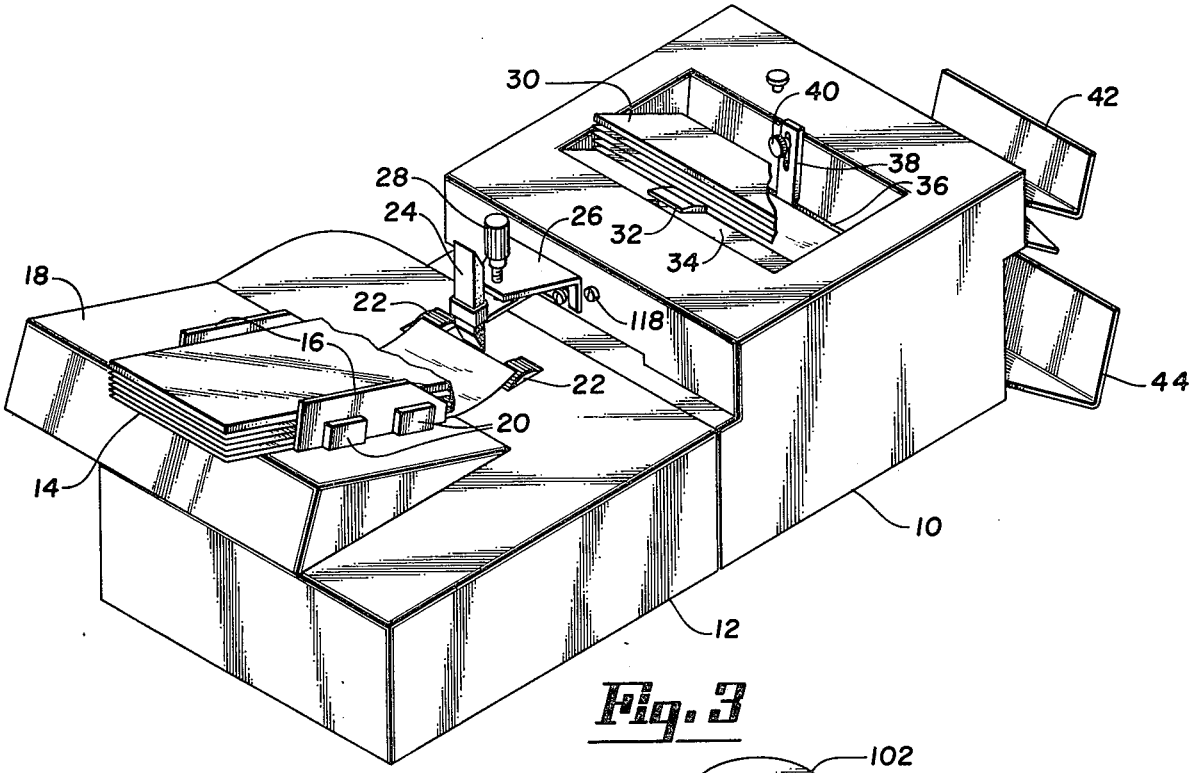
FIG. 1 is a simplified isometic view of the addressing machine and the automatic workpiece feed mechanism.

FIG. 1 shows the two modules of the addressing machine of my invention. An addressing module 10 is both mechanically and electrically connected to an automatic envelope feeding module 12 which may be easily disconnected to allow addressing module 10 to be operated as a manually fed addressing machine.

Automatic envelope feed module 12 accepts a stack of workpieces or envelopes 14 which are held in alignment by adjustable envelope supports 16 which are held in position on the inclined envelope receiving surface 18 of the automatic envelope feed module 12 by magnets 20 which permit the adjustment of the envelope supports to accommodate varying envelope sizes.

Envelopes 14 are shown in FIG. 1 in semicutaway form to illustrate the alignment of the bottom envelope on envelope feeding module 12 and its relationship to envelope feed roller means 22. When driven, envelope feed roller means 22 engages the bottom surface of the bottom envelope in the stack of workpieces and separates it from the stack while driving it toward the addressing module 10. The passage of more than one envelope from envelope feeding module 12 to addressing module 10 is prohibited by envelope restraining means 24 which is normally formed from a piece of rubber such as an eraser which is suspended from a bracket 26 and adjustably positioned over the point of tangency between the envelope feed roller means 22 and the lowermost envelope from the envelope stack. Restraining means 24 is separated from the point of tangency by a distance slightly in excess of the thickness of the particular envelope being fed. As shown in FIG. 1, the vertical height of the envelope restraining means is adjusted by a thumbscrew 28.

Master cards 30 are shown in a partial cutaway view loaded in the master card feed magazine portion of the addressing module 10. The master cards are oriented with the reverse image form of the printed material oriented downwardly so as to engage the solvent moistened face of the workpiece with which it is to be brought in contact. The lowermost master card in the master card magazine is stripped from the stack of master cards by a stripper plate 32 which is reciprocally driven along a slot on the inclined master card receiving surface 34. The stripper plate engages only the lowermost card on the stack and propels it downwardly along surface 34 through an aperture 36 to the printing area where it engages the moistened envelope. The feeding of multiple cards is inhibited by card restraining means 38 which is adjustably positioned in the aperture 36 to provide a space for the passage of only a single card for each cycle of stripper plate 32. Vertical adjustment of the card restraining means 38 is accomplished by use of adjustment thumbscrew 40.

After the completion of the envelope addressing sequence, master cards are ejected into master card receiving bin 42 and addressed envelopes are ejected from the addressing module into an envelope receiving bin 44.

Figure 2:
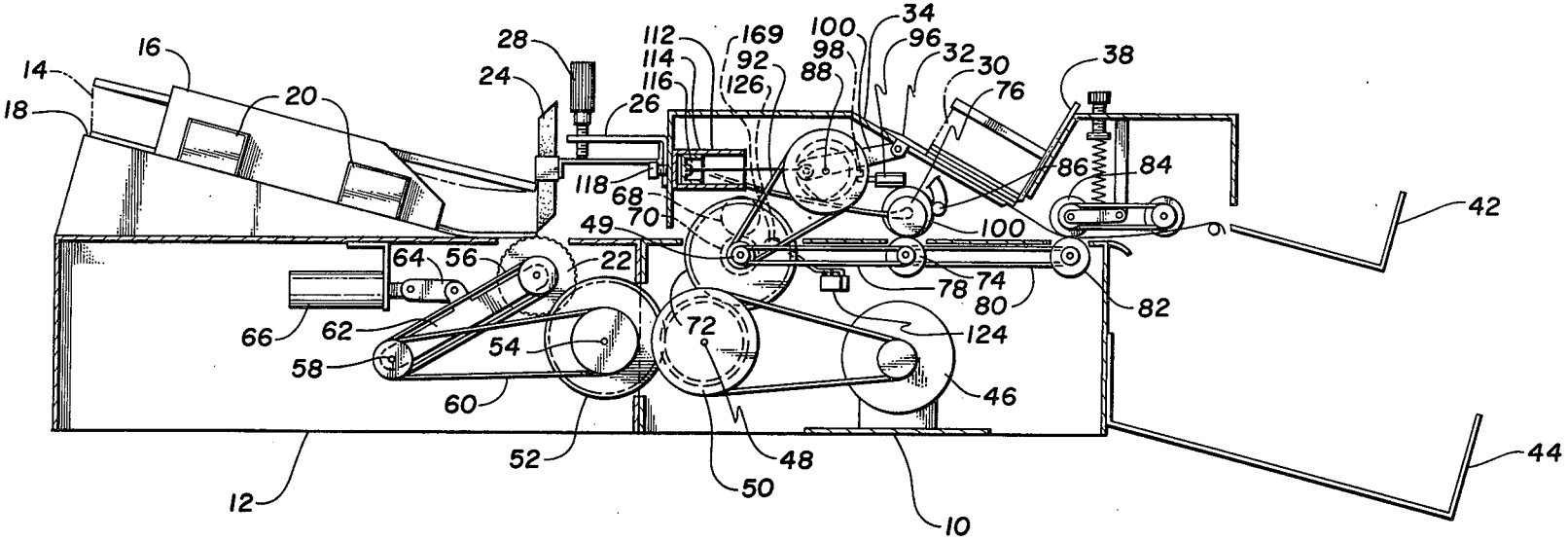
FIG. 2 is a side cross sectional view of the addressing machine and envelope feeding means.

In FIG. 2, the cross sectional view of the machine shows additional detail as to its workings. A motor 46 drives a roller drive shaft 48 which in turn drives through spur gears 50 and 52, an additional shaft 54. As may be seen in FIG. 2, spur gear 52 projects through an aperture in the side plate of automatic envelope feeding module 12 so that it can engage spur gear 50 when automatic feed module 12 is placed in confronting relationship with addressing module 10. The two modules can be maintained in a semipermanent confronting relationship by means of well known clamping or bolt arrangements, not shown. Thus, addressing module 10 can be operated alone for the manual feeding of envelopes and can readily be expanded to an automatic envelope feed addressing machine by placing the automatic envelope feed module against the addressing module without the necessity of making any complex mechanical power connections.

Figure 5:
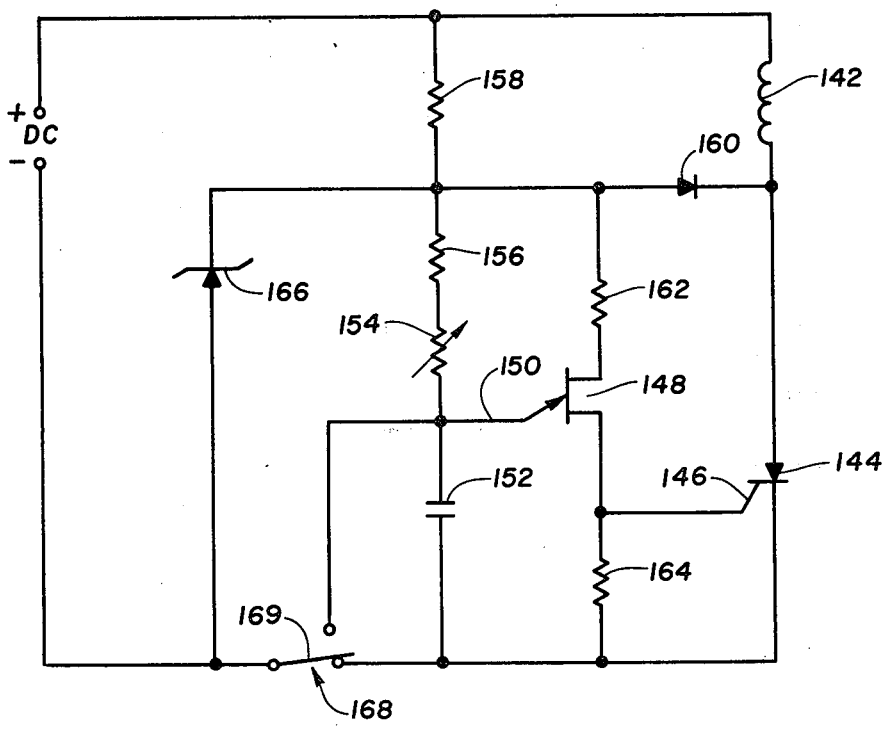
FIG. 5 is an electrical schematic of the circuitry used to control the envelope automatic feed mechanism.

Envelope feed roller means 22 is driven by a drive belt 56 which is in turn driven from a shaft 58 which receives its power through a drive belt 60 connected to additional shaft 54. Envelope feed roller means 22 and drive shaft 58 are mounted at opposite ends of a link 62 which is mounted for pivotal movement about drive shaft 58. The midpoint of link 62 is connected through a clevis 64 to a solenoid 66 which, when actuated, pivots link 62 in a counterclockwise direction about shaft 58 to raise envelope feed roller 22 through the aperture in the top plate of automatic envelope feed module 12 to engage the lower most envelope and drive it toward addressing module 10. The control circuit for actuating solenoid 66 is shown in FIG. 5 and will be discussed below. Connection of the solenoid actuaation wiring to solenoid 66 is by means of male and female connectors mounted on the chassis of modules 10 and 12 for easy connection and disconnection.

An envelope may be inserted into the addressing module 10 by the automatic envelope feed module 12 or may be manually inserted by an operator. In either case, the envelope is initially engaged by a pair of feed rollers 68 and 70. Feed roller 70 is driven by a spur gear 72 which engages a mating spur gear connected to roller drive shaft 48.

The shaft 49 upon which feed roller 70 and spur gear 72 are mounted drives a further pair of rollers 74 and 76 through a belt 78. A further belt 80 connected at one end to the shaft of roller 70 drives a print roller 82 which cooperates with a second print roller 84.

Driven roller pairs 68 70, 74 76 and 82 84 serve to propel the envelope through the entire addressing module and deposit it in envelope receiving bin 44. In order to print an impression upon an envelope passing through module 10, the envelope must be moistened in the location where the address is to be applied by action of moistening roller 100 which receives its solvent from solvent wick 86 which moistens the surface of the roller as it rotates. The envelope which has been moistened by roller 100 is then brought into contact with the imprint face of the master card upon which the reverse image of the printed matter appears while pressure is applied to the master card 30 and the envelope 14 by printing rollers 82 and 84 to duplicate the printed material on the envelope.

Figure 3:
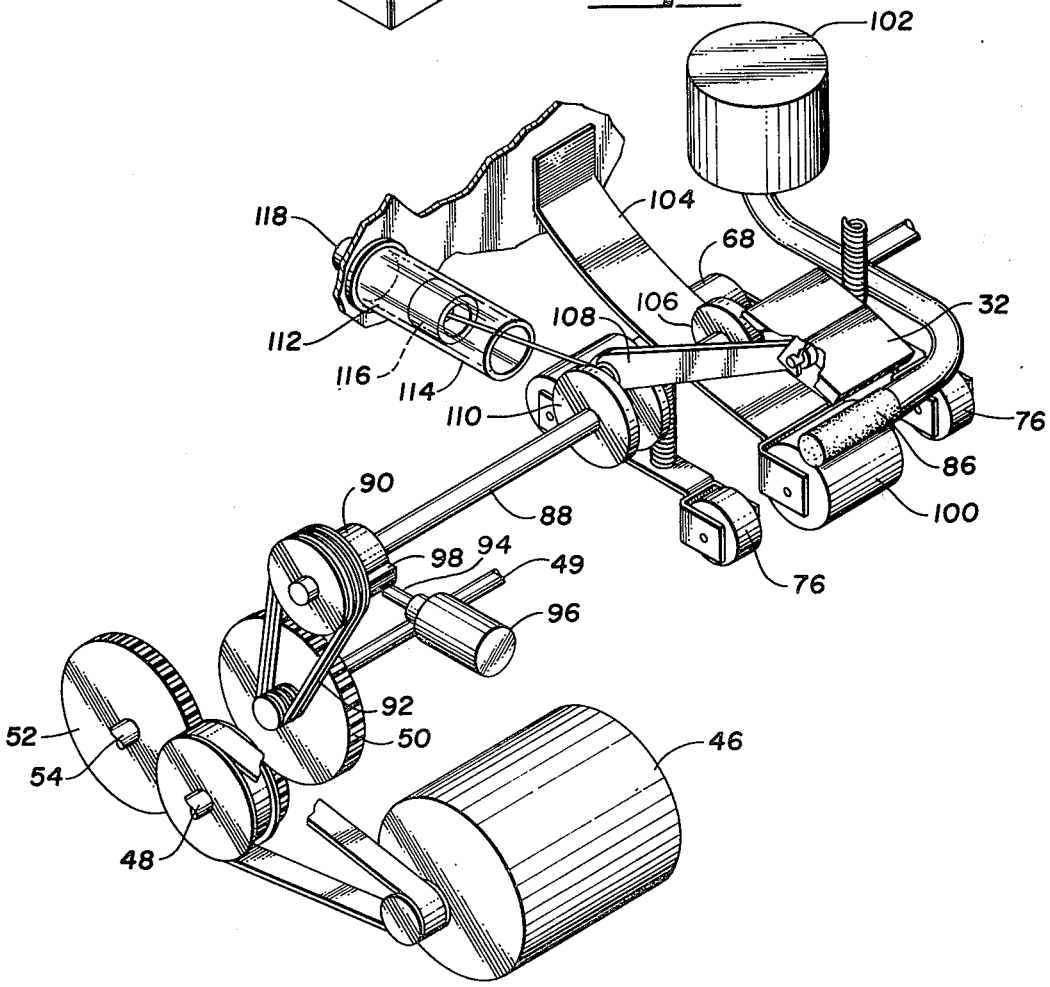
FIG. 3 is a detailed view of the address location adjustment mechanism.

Referring now to FIG. 3, the detail of the mechanism used to control the application of solvent to the envelope and to control the location of the address on the face of the envelope is shown in greater detail. Motor 46 drives shaft 48 through a belt connection and shaft 48 directly provides the drive to spur gear 52 in the automatic envelope feed module 12 and through spur gear 72 to the three pairs of rollers which propel the envelope through the addressing module 10. In addition to providing the direct drive for the rollers used to feed the envelope through the entire machine, roller drive shaft 48 is intermittently connected to a further drive shaft 88 by means of a one-way clutch 90 which is connected by means of a resilient coupling 92 to shaft 49. Resilient coupling 92 is shown in FIG. 2 as formed from several flexible o-rings or rubber drive belts connected in parallel.

Rotation of shaft 88 is restrained by the armature 94 of solenoid 96 which engages a projecting lobe 98 on the body of the one-way clutch. When the solenoid 96 is operated, armature 94 is pulled out of engagement with lobe 98 permitting shaft 88 to be driven in a clockwise direction by belt 92. The one way clutch and solenoid can be described as functioning as a single revolution clutch which permits a complete revolution of shaft 88 each time that solenoid 96 is energized.

The control circuitry for solenoid 96 is shown separately in FIG. 4 and is described in detail below. The control circuitry causes solenoid 96 to be actuated for less time than is required for a single revolution of shaft 88 so that armature 94 returns to its initial position for restraining lobe 98 prior to the completion of one revolution by shaft 88. Thus, each time solenoid 96 is operated by the control circuitry of FIG. 4, shaft 88 rotates through a single revolution.

The rotation of shaft 88 directly controls the actuation of solvent to the workpiece. The solvent is applied by a moistening roller 100 which is in contact with solvent wick 86 which receives its supply of fluid from a fluid reservoir 102. Moistening roller 100 is mounted on a leaf spring 104 which is attached to the wall of addressing module 10. Leaf spring 104 and moistening roller 100 normally cooperate so that moistening roller 100 is not in contact with a workpiece being driven through the machine by rollers 74 and 76. As shaft 88 is rotated, however, cam 106 which is driven by roller 88 forces moistening roller 100 into contact with a workpiece passing below it. The dwell time of the cam is determined to be sufficient to moisten an area of the envelope corresponding to the area of printed material to be duplicated.

The feeding of master cards by stripper plate 32 is also controlled by further drive shaft 88. The stripper plate is connected through a connecting rod 108 to a crank 110 which is mounted on shaft 88. A single revolution of shaft 88 drives the stripper plate 32 through one complete cycle to remove the lowermost card from the card magazine and drive it through aperture 36 into the nip of printing rollers 82 and 84. The angular phase relationship of cam 106 and the crank 110 which actuates card stripper plate 32 are synchronized so that cam 106 will cause moistening roller 100 to contact a portion of a workpiece passing thereunder and the crank 110 connecting rod 108 stripper plate 32 combination will deliver a card to printing rollers 82 and 84 with its reverse image imprint area in confronting relation with the moistened portion of envelope 14.

In order to vary the location of the duplicated printed material upon an envelope, it has been found necessary in prior art addressing machines to employ elaborate mechanical or electrical time delay circuits, for example, to alter the time relationship of the operation of the moistening roller and the card stripper relative to the time when an envelope is fed into the machine. In the present invention, a relatively simple and inexpensive means has been found to alter the position of the address on an envelope by varying the amount of viscous drag experienced by drive shaft 88. Because shaft 88 is driven by resilient coupling 92, the rotational shaft 88, after actuation of single revolution clutch solenoid 96, doen not instantaneously follow the rotation of roller drive shaft 48, but tends to lag the rotation of roller drive shaft 48 by an amount related to the amount of viscous drag experienced by shaft 88. In the present invention, the viscous load on shaft 88 can be readily adjusted by means of damper pot 112 which is connected to crank 110. Damper pot 112 comprises a cylinder member 114 into which is inserted a piston member 116 which fits snuggly into the cylinder. The cylinder contains a variable aperture orifice to the ambient air so that when the piston 116 is moved, the air pressure within the cylinder can be equalized by the flow of air through the orifice. By controlling the size of the orifice, the resistance to movement of the piston within the cylinder can be altered to change the viscous load presented by the damper pot. The damper pot 112 is attached to the wall of addressing module 10 with its adjustment knob 118 projecting through the wall for ready adjustment. Damper pot assemblies such as 112 are manufactured by Airpot Corporation, 27 Lois Street, Norwalk, Connecticut, 06851.

Adjustment of knob 18 varies the viscous drag of damper pot 112 and thereby varies the dynamic load on shaft 88 causing it to lag the roational shaft 48 by a selectable increment to permit a variation of the relative positions of an envelope 14 and a master card 30 as they reach the printing rollers 82 and 84.

Figure 4:
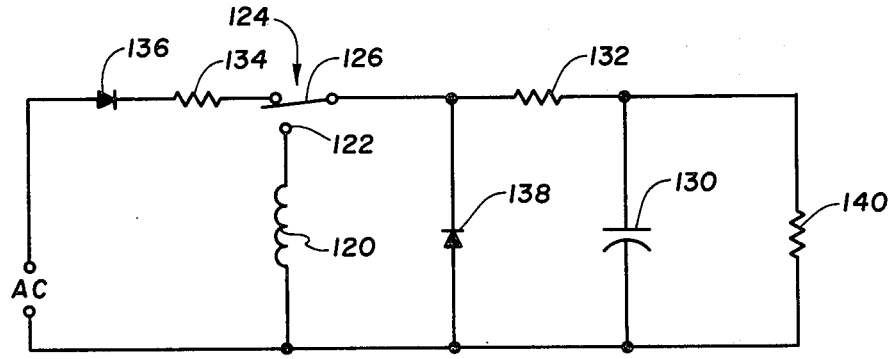
FIG. 4 is an electrical schematic of the circuitry used to control the single revolution clutch mechanism of the addressing machine.

Control circuitry for operating the single revolution clutch is shown in FIG. 4. A solenoid winding 120 of single revolution clutch solenoid 96 is connected to the AC return and to the normally open contact 122 of switch 124, the location of which is shown in FIG. 2. The actuation arm 126 of switch 124 is placed in the envelope feed path to sense the delivery of an envelope through feed rollers 68 and 70. As soon as an envelope is sensed as having passed through feed roller 68 and 70, switch 124 is moved to close its normally open contacts and provide a circuit from solenoid 120 through normally open contacts 122 and switch wiper 128 to connect to capacitor 130 across solenoid winding 120 through a series path which also includes a small surge current limiting resistor 132. When switch 124 is in the unactuated position, capacitor 130 is charged through a current limiting resistor 132, switch wiper 126, a further current limiting resistor 134 and a rectifying diode 136. When the switch is in the unactuated mode, capacitor 130 is charged to a DC level. When switch 126 is closed, capacitor 130 is discharged across solenoid winding 120 to momentarily actuate solenoid 96 to permit rotation of shaft 88. Since capacitor 130 can store only a predetermined quantity of energy when switch 124 is in its normal position, the actuation of solenoid 96 is only for a time period determined by the size of capacitor 130. Diode 138 and the large resistor 140 are intended to suppress the inductive switching transient caused by solenoid winding 120. It may be seen that when switch 124 is actuated, there is no variable time delay between the closing of that switch and the actuation of the single revolution clutch solenoid 96.

FIG. 5 is an electrical schematic of the control circuitry for solenoid 66 which is used to tilt envelope feed roller means 22 into contact with the lowermost envelope 14 loaded on the automatic envelope feed module 12. The solenoid winding 142 of solenoid 66 is connected at one end to a source of DC power and at the other end of a silicon controlled rectifier switch 144 which has its gate 146 connected to a unijunction transistor 148 which has its emitter 150 connected to a time delay capacitor 152 which receives its charging current through resistors 154, 156 and 158 from the DC supply. The remainder of the control circuit comprises a diode 160 which is connected between resistor 158 and silicon controlled rectifier 144 to provide it with a component of non-inductive load to facilitate the firing of rectifier 144 when its gate 146 is actuated. Unijunction transistor 148 is connected to resistor 158 through a resistor 162 and is connected to a DC common through a resistor 164. A zener diode 166 is connected between resistor 158 and the DC return to provide a regulated charging current for the timing circuit of capacitor 152 and resistors 154 and 156.

A switch 168 has its wiper 169 connected to the DC return and its normally closed contact connected to the DC common line and its normally open contact connected to the point of connection between resistor 154 and capacitor 152. Switch 168 is located adjacent switch 124 on the addressing module chassis 10 with its actuation arm 169 adjacent actuation arm 126 of switch 124 to sense the presence of a card 14 emerging from feed rollers 68 and 70. When switch 168 is actuated, the point of connection between capacitor 152 and resistor 154 is connected through the switch wiper to the DC return to ground emitter 150 of unijunction transistor 148.

When an envelope is inserted through the drive roller 68 and 70 and contacts acutation arm 169, it connects the DC common to the DC return and permits the voltage on capacitor 152 to begin to increase as the charging current through resistors 154 and 156 permits the voltage at 150 to rise. After the voltage on 150 has risen to the firing threshold of unijunction transistor 148, it fires, developing a sufficient voltage across resistor 164 to fire silicon controlled rectifier 144 to actuate solenoid winding 142 and cause solenoid 66 to tilt link 62 o engage another envelope with envelope feed roller means 22. The solenoid will continue to be actuated until the envelope which is being fed from envelope feed means 12 has passed through the feed rollers 68 and 70 of addressing module 10 and switch 168 is again actuated. At that time the DC return for the current passing through solenoid winding 142 of solenoid 166 is cut off and the envelope feed roller means 22 returns to its normal position where it continues to rotate without engaging an envelope. The current through resistors 154 and 156 charges capacitor 152 until the sequence is again initiated after a predetermined time delay to feed a further envelope.

The addressing machine of the present invention can be adapted to operate in a selective manner with only minor modification. Any one of a number of the prior art sensors can be used to read indicia on the lowest master card 30 as it lies on the inclined master card receiving surface 34 awaiting feeding by the stripper plate 32. Well known logic circuitry can be used to compare the indicia on each card with the criteria selected and determine whether or not it is desired to duplicate the printed material from a particular card onto an envelope. In the event that it is desired to print a particular card, the normal printing cycle described above will continue in exactly the same fashion. If, on the other hand, it is desired to not print a particular master card, the logic circuitry comparing the indicia on the card to the criteria selected for printing will provide a card feed inhibiting signal to the actuation circuitry for solenoid 66 to inhibit the operation of that circuitry while at the same time actuating the single revolution clutch for a single revolution to feed the card which is not to be printed into the master card receiving bin and allow the indicia on the subsequent card to be examined.

Although I have shown a series of O-rings for the resilient coupling 92, it is also possible to provide the resilient coupling using a torsional spring coupling to drive shaft 88 from the main drive shaft.

Additional modifications and changes may be made to the addressing machine described above without departing from the scope and spirit of the invention which is set forth in the claims below.

I claim:

1. A machine for duplicating printed matter from an imprint area of a master card to a selected area on one face of a workpiece comprising:

rotary drive means for imparting rotary motion to a first shaft;

transfer means driven by said first shaft, said transfer means accepting said workpiece upon which material is to be duplicated and transporting the workpiece continuously along a transfer path through the machine;

workpiece moistening means for applying solvent to at least a portion of said face of said workpiece as said workpiece is transported along the transfer path;

card feed means mounted on a shaft for delivering a single master card each time its said shaft is rotated through a complete revolution;

clutch means connected to transmit rotary motion from an input shaft to said shaft of said card feed means to drive said card feed means only when actuated;

means for actuating said clutch when a workpiece reaches a predetermined point on the transfer path, and rotating said shaft of said card feed means through one complete revolution to deliver said single master card with said imprint area in confronting aligned relationship with said moistened portion of said face of said workpiece as said workpiece is transported along the transfer path;

resilient coupling means connected to said first shaft and said input shaft of said clutch means for providing a resilient coupling between said first shaft and said input shaft of said clutch means whereby the rotary motion of said input shaft of said clutch means is permitted to lag the rotary motion of said first shaft;

adjustable drag means comprising a piston mounted in a cylinder having a variable aperture orifice therein to control the amount of drag, said drag means connected to said card feed means to adjustably inhibit motion thereof, said adjustable drag means and said resilient coupling means cooperating to adjustably inhibit rotational movement of said shaft of said card feed means relative to said first shaft to cause said card feed means to provide an adjustable time lag in the delivery of said master card from said card feed means relative to the transporting of said workpiece through the machine thereby altering the location of the area on said workpiece where the printed matter is to be duplicated.

* * * * *